US006533685B1

(12) United States Patent
Otten et al.

(10) Patent No.: US 6,533,685 B1
(45) Date of Patent: Mar. 18, 2003

(54) BAT WEIGHT AND PROTECTOR

(76) Inventors: Gregg G. Otten, 9436 Yucca La. N., Maple Grove, MN (US) 55369; Reginald P. Costigan, 5840 6th St. NE., Fridley, MN (US) 55432

( * ) Notice: Subject to any disclaimer, the term of this patent is extended or adjusted under 35 U.S.C. 154(b) by 0 days.

(21) Appl. No.: 09/592,760

(22) Filed: Jun. 13, 2000

(51) Int. Cl.[7] ..... A63B 69/00; A63B 59/00
(52) U.S. Cl. ..... 473/437; 473/457; 473/564
(58) Field of Search ..... 473/437, 464, 473/564, 567, 568, 457, 520; 463/47.1–47.7; 482/109

(56) References Cited

U.S. PATENT DOCUMENTS 805,132 A * 11/1905 Gubbins ..... 473/564
3,521,883 A * 7/1970 Hamilton ..... 473/437
3,618,945 A * 11/1971 Kuchar ..... 473/457
3,623,724 A * 11/1971 Lande ..... 473/437
4,214,751 A * 7/1980 Simpson ..... 473/457
5,050,877 A * 9/1991 Wales ..... 473/437
5,348,296 A * 9/1994 Frederiksen ..... 463/47.2
5,701,998 A * 12/1997 Perry et al. ..... 473/564
5,888,154 A * 3/1999 Hartman ..... 473/457
5,980,397 A * 11/1999 Hart et al. ..... 473/437
6,053,828 A * 4/2000 Pitsenberger ..... 473/566
6,093,114 A * 7/2000 Haringa ..... 473/329

* cited by examiner

*Primary Examiner*—Paul T. Sewell
*Assistant Examiner*—Mitra Aryanpour
(74) *Attorney, Agent, or Firm*—Hugh D. Jaeger

(57) ABSTRACT

A bat weight and protector which is a removable soft-sided weight and protector for the attachment to a baseball or softball bat for the purpose of warming up a batter in the on-deck circle, prior to entering the batter's box and facing the pitcher. The bat weight and protector is comprised of a soft weighted cylindrical portion made of rubber or other suitable material, a retainer ring and webbing straps, which at one end are equally spaced around a retainer ring and stitched thereto, and at the opposite end are looped around the cylindrical portion and stitched thereto. A knob end of a bat is passed through the cylindrical portion of the bat weight and protector and further through the retainer ring until the tapered portion of the bat prevents further travel. In this position, the cylindrical portion of the bat weight and protector is over and about a barrel of the bat. This position maximizes the batter's swing resistance during warm-ups and protects the striking surface of the bat.

6 Claims, 3 Drawing Sheets

BAT WEIGHT AND PROTECTOR

CROSS REFERENCES TO CO-PENDING APPLICATIONS

None.

BACKGROUND OF THE INVENTION

1. Field of the Invention

The present invention is for a bat weight and protector, and more particularly, pertains to a bat weight and protector for use with a baseball or softball bat. Swing resistant methods and devices have been in existence for many years. A common method for increasing swing resistance is to swing multiple units of the apparatus one would eventually use to strike a ball. For example, a baseball player would swing multiple bats to warm himself up. Two other methods include a separate rigid weighted cylinder that would slide over the bat barrel, but not exceed the tapered end of the bat's barrel, and a weighted donut slid over the knob and rest near the grip of the tapered portion of the bat. The more distal the weight from the barrel end of the bat, the heavier the weight needs to be, and the more proximal the weight to the barrel end of the bat, the less weight required to produce the necessary swing resistance to warm up the batter.

2. Description of the Prior Art

The location of the bat weight of the prior art is prohibitive and requires more weight to achieve the desired effect to warm up a batter. The weighted portion of the present invention is located closer to the barrel end of the bat and requires less mass and weight to achieve the desired effect. This invention also has a larger outside diameter which creates more wind resistance when positioned over the barrel end of the bat as it is swung. Prior art devices are dangerous if accidental detachment occurs during use. This invention is very different. It is very soft and unlikely to cause harm if detachment from the bat occurs.

The present invention is also used as a protector for barrel end of a bat while in a bat bag during travel or in the dugout between uses, whereas the prior art does not exhibit dual purpose qualities.

SUMMARY OF THE INVENTION

The general purpose of the present invention is a bat weight and protector.

According to one embodiment of the present invention, there is provided a bat weight and protector, including a soft weighted cylindrical portion made of rubber or other suitable material, a retainer ring and webbing straps, which at one end are equally spaced around the retainer ring and stitched thereto, and at the opposite end the webbing straps are looped around the cylindrical portion and stitched thereto. The cylindrical portion is positioned over the barrel end of a bat and is held in place by the retainer ring. The bat weight and protector not only safely provides added weight to the barrel end of a bat for use during warm-ups, but also protects the bar when not in use.

One significant aspect and feature of the present invention is the positioning of the weight near the barrel end of a bat.

Another significant aspect and feature of the present invention is the soft rubber which the weight is made from creating a safe, cushioned device.

A further significant aspect and feature of the present invention is a water resistant device that will not be affected by rain and will not rust.

An additional significant aspect and feature of the present invention is webbing straps which are durable, light and strong.

Still another significant aspect and feature of the present invention is the ability to have dual purpose as a bat protector and weight.

Yet another significant aspect and feature of the present invention is an optional clip for attaching a bat to a fence when not in use.

Having thus described embodiments and significant aspects and features of the present invention, it is the principal object of the present invention to provide a bat weight used for warm-up swings.

One object of the present invention is to provide a bat weight which allocates the weight to the barrel end of the bat.

Another object of the present invention is to use less weight to achieve the same resistance during a practice swing.

A further object of the present invention is to provide a means of protecting a bat when not in use.

An additional object of the present invention is to provide a means of clipping a bat to a fence when not in use.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
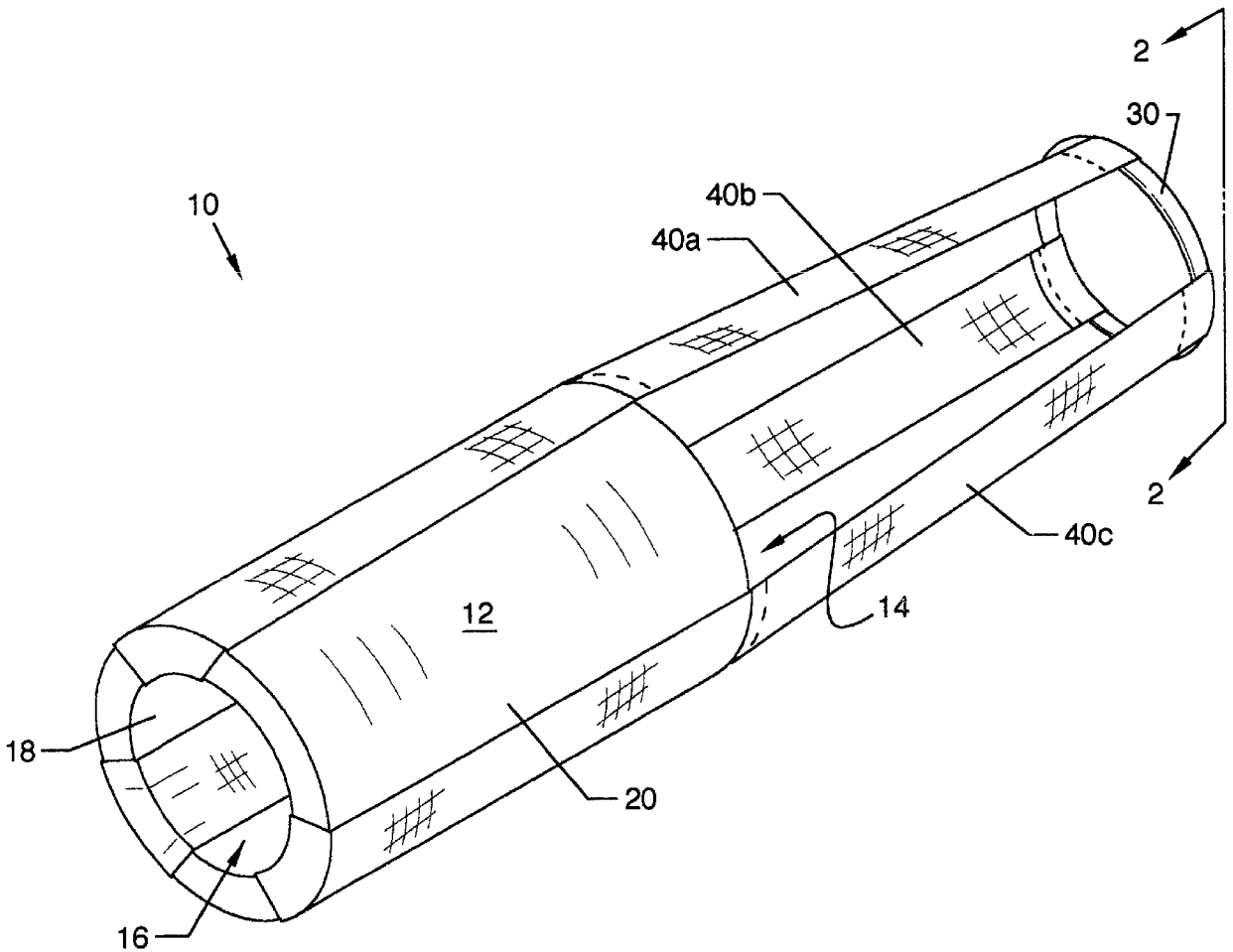
FIG. 1 illustrates an isometric view of a bat weight and protector, the present invention.

FIG. 1 illustrates an isometric view of a bat weight and protector 10, the present invention. The bat weight and protector is comprised of a soft, weighted cylindrical portion 12 made of Neoprene or other suitable material having an inwardly facing opening 14, an outwardly facing opening 16, an interior wall 18, and an exterior wall 20 which is connected to a retainer ring 30 by three webbing straps 40*a*–40*c* which are configured to loop around the retainer ring 30 at one end and loop around the cylindrical portion 12 of the bat weight and protector at the opposite end.

Figure 2:
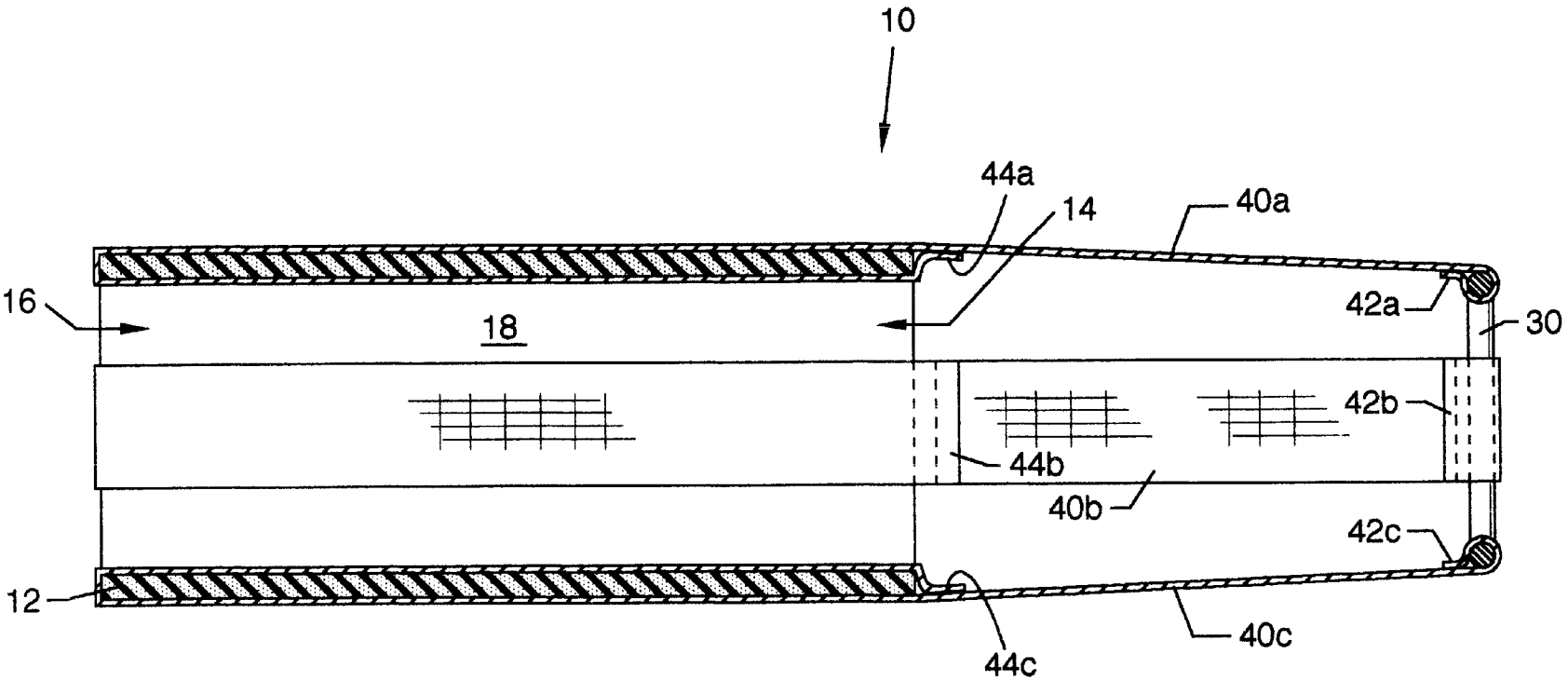
FIG. 2 illustrates a cross sectional view along line 2—2 of FIG. 1; and, FIG. 3 illustrates a side view of the bat weight and protector appropriately positioned over and about a bat.

FIG. 2 illustrates a cross sectional view along line 2—2 of FIG. 1, where all numerals mentioned before correspond to those elements previously described. Illustrated in particular is the securing of the webbing straps 40*a*–40*c*. One end of each of the webbing straps 40*a*–40*c* forms a loop which captures the retainer ring 30 and is secured to itself by stitching 42*a*–42*c*. The opposite ends of the webbing straps 40*a*–40*c* pass over the exterior wall 20 of cylindrical portion 12 to the outwardly facing opening 16 where each of the webbing straps 40*a*–40*c* internally continues along the interior wall 18 of cylindrical portion 12 forming a loop capturing cylindrical portion 12 where the webbing straps

40*a*–40*c* are secured to themselves by stitching 44*a*–44*c*. This illustration shows stitching as the securation means, but it is understood that other appropriate securation means can be used without compromising the characteristics or integrity of the present invention.

MODE OF OPERATION

Figure 3:
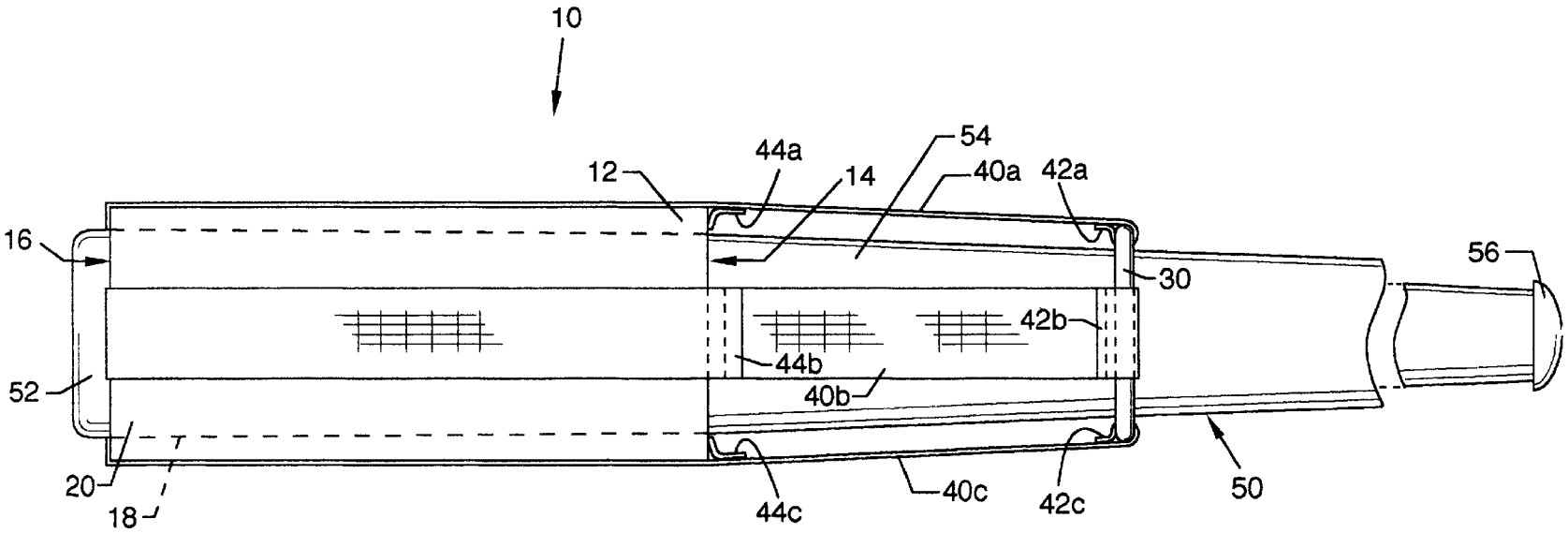

FIG. 3 illustrates a side view of the bat weight and protector 10 appropriately positioned over and about a bat 50, where all numerals mentioned before correspond to those elements previously described. The knob end 56 of bat 50 is slid through the interior of cylindrical portion 12 and through the retainer ring 30. The bat weight and protector 10 is then further slid toward the barrel end 52 of bat 50 until retainer ring 30 is seated against the tapered portion 54 of bat 50. The interior diameter of cylindrical portion 12 is equal to or greater than the exterior diameter of the barrel end 52 of bat 50. The bat weight and protector 10 is frictionally engaged by the bat 50 and is further held in place by centrifugal force when the batter swings bat 50 during warm-ups. Optionally, a clip (not illustrated) may be stitched to any of the webbing straps 40*a*–40*c* for clipping the bat weight and protector 10 engaged over and about the bat 50 to a fence when not in use.

Various modifications can be made to the present invention without departing from the apparent scope hereof.

It is claimed:

1. A bat weight, for use on a bat having a knob end, a tapered portion, and a cylindrical barrel, the bat weight comprising:

a. a rubber sleeve having an interior sized to contain the cylindrical barrel of the bat;

b. a retainer ring having an inner diameter engageable on the tapered portion of the bat;

c. a plurality of straps having one end secured by means over and about said rubber sleeve and an other end secured by like means over and about said retainer ring, said plurality of straps arranged for longitudinal orientation along the bat; and, d. said securing means includes stitching.

2. The bat weight of claim 1, wherein the plurality of straps consists of three straps.

3. The bat weight of claim 1, wherein the rubber sleeve and the retainer ring are spaced apart.

4. The bat weight of claim 1, wherein the straps are webbing straps.

5. The bat weight of claim 1, wherein the straps are flexible.

6. The bat weight of claim 1, wherein centrifugal force during swinging of the bat seats the retaining ring against the tapered portion of the bat and the straps hold the rubber sleeve over the barrel.

* * * * *